US011066085B2

(12) United States Patent
Tamura et al.

(10) Patent No.: US 11,066,085 B2
(45) Date of Patent: Jul. 20, 2021

(54) AXLE BOX SUSPENSION OF RAILCAR

(71) Applicant: KAWASAKI JUKOGYO KABUSHIKI KAISHA, Kobe (JP)

(72) Inventors: Yoshihiro Tamura, Kobe (JP); Yukitaka Taga, Kobe (JP); Fumikazu Kounoike, Kakogawa (JP); Takaya Ono, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/482,197

(22) PCT Filed: Jan. 16, 2018

(86) PCT No.: PCT/JP2018/000921
§ 371 (c)(1),
(2) Date: Jul. 30, 2019

(87) PCT Pub. No.: WO2018/139251
PCT Pub. Date: Aug. 2, 2018

(65) Prior Publication Data

US 2020/0039541 A1 Feb. 6, 2020

(30) Foreign Application Priority Data

Jan. 30, 2017 (JP) ..... JP2017-013773

(51) Int. Cl.
*B61F 5/30* (2006.01)

(52) U.S. Cl.
CPC ..... *B61F 5/301* (2013.01)

(58) Field of Classification Search
CPC .... B61F 5/302; B61F 5/32; B61F 5/46; B61F 5/52; B61F 3/02; B61F 5/305;
(Continued)

(56) References Cited

U.S. PATENT DOCUMENTS 5,299,871 A * 4/1994 Hancock ..... F02F 7/0053 123/195 R
2011/0253004 A1* 10/2011 Nishimura ..... F16F 1/38 105/220

(Continued)

FOREIGN PATENT DOCUMENTS

CN 201300859 Y 9/2009
CN 104884329 A 9/2015

(Continued)

OTHER PUBLICATIONS

Feb. 20, 2018 Search Report issued in International Patent Application No. PCT/JP2018/000921.

*Primary Examiner* — Mark T Le
(74) *Attorney, Agent, or Firm* — Oliff PLC

(57) ABSTRACT

An axle box suspension of a railcar includes: a coupler extending from the axle box in a car longitudinal direction and including a tubular portion at a tip end portion of the coupler, the tubular portion opens toward both sides in a car width direction, the coupler coupling the axle box and a bogie frame; a core rod inserted into an internal space of the tubular portion, a pair of protruding portions provided at both respective sides of the core rod in the car width direction; an elastic bushing interposed between the tubular portion and the core rod; a pair of receiving seats at the bogie frame, including a pair of recess portions and a pair of groove portions, a pair of lids supporting the pair of protruding portions fitted into the pair of groove portions, and fasteners fixing the lids to the receiving seats.

6 Claims, 3 Drawing Sheets

(58) Field of Classification Search
CPC .... B61F 5/325; B61F 5/36; B61F 5/50; B61F 5/30; F16C 11/02; F16C 11/04; F16C 9/02; F16C 9/04
USPC ..... 105/206.2, 206.1
See application file for complete search history.

(56) References Cited

U.S. PATENT DOCUMENTS

| | | | |
|---|---|---|---|
| 2015/0344046 | A1 | 12/2015 | Nishimura et al. |
| 2016/0304102 | A1 | 10/2016 | Okumura et al. |
| 2016/0320229 | A1 | 11/2016 | Nishimura et al. |

FOREIGN PATENT DOCUMENTS

| | | | |
|---|---|---|---|
| JP | H03-62216 | U | 6/1991 |
| JP | 2005-249019 | A | 9/2005 |
| JP | 2015-107773 | A | 6/2015 |
| WO | 2015/098091 | A1 | 7/2015 |

* cited by examiner

AXLE BOX SUSPENSION OF RAILCAR

TECHNICAL FIELD

The present invention relates to an axle box suspension of a railcar, the axle box suspension coupling an axle box to a bogie frame.

BACKGROUND ART

In a railcar bogie, an axle box is supported by an axle box suspension so as to be displaceable relative to a bogie frame. There are various types of axle box suspensions. For example, in an axle beam type axle box suspension disclosed in PTL 1, an axle spring constituted by a coil spring is interposed between an axle box and a bogie frame, and a tip end portion of an axle beam extending from the axle box in a car longitudinal direction is supported by receiving seats of the bogie frame. A tubular portion is formed at the tip end portion of the axle beam, and a core rod is inserted into the tubular portion through a rubber bushing. A pair of protruding portions formed on both respective car width direction side surfaces of the core rod are fitted into fitting grooves of the receiving seats of the bogie frame from below. Projecting portions of lids each having a convex shape are fitted into the fitting grooves so as to support the protruding portions from below, and base portions of the lids are arranged so as to be opposed to lower surfaces of the receiving seats. The base portions are fixed to the receiving seats by bolts.

CITATION LIST

Patent Literature

PTL 1: Japanese Laid-Open Patent Application Publication No. 2015-107773

SUMMARY OF INVENTION

Technical Problem

According to the configuration of PTL 1, both the protruding portion of the core rod and the projecting portion of the lid are fitted into the fitting groove of the bogie frame. Therefore, the position of a circular-arc surface constituting an inner surface of the fitting groove and contacting the protruding portion of the core rod and the position of a flat surface constituting the inner surface of the fitting groove and contacting the projecting portion of the lid need to coincide with each other in the car longitudinal direction. Therefore, high machining accuracy is required when forming the above surfaces constituting the inner surface of the fitting groove through separate steps.

An object of the present invention is to provide an axle box suspension which relaxes the requirement of machining accuracy of a receiving seat and a lid, and therefore, improves productivity.

Solution to Problem

An axle box suspension of a railcar according to one aspect of the present invention is an axle box suspension of a railcar, the axle box suspension coupling an axle box to a bogie frame. The axle box suspension includes: a coupler extending from the axle box in a car longitudinal direction and including a tubular portion at a tip end portion of the coupler, the tubular portion being open toward both sides in a car width direction, the coupler coupling the axle box and the bogie frame; a core rod inserted into an internal space of the tubular portion, a pair of protruding portions being provided at both respective sides of the core rod in the car width direction; an elastic bushing interposed between the tubular portion and the core rod; a pair of receiving seats provided at the bogie frame and including a pair of recess portions and a pair of groove portions formed by depressing parts of bottom surfaces of the recess portions; a pair of lids supporting the pair of protruding portions fitted into the pair of groove portions, the pair of lids being fitted into the pair of recess portions; and fasteners fixing the lids to the receiving seats.

According to the above configuration, a width of the recess portion of the receiving seat at which the lid is positioned is larger than a width of the groove portion at which the protruding portion of the core rod is positioned, and therefore, the position of the recess portion and the position of the groove portion are not required to coincide with each other. Therefore, one of the recess portion and the groove portion does not have to be machined in accordance with the width of the other of the recess portion and the groove portion, and thus, the requirement of the machining accuracy regarding the relative positional relation between the recess portion and the groove portion can be significantly relaxed.

Advantageous Effects of Invention

According to the present invention, the requirement of the machining accuracy of the receiving seat can be significantly relaxed, and therefore, the productivity improves.

DESCRIPTION OF EMBODIMENTS

Hereinafter, an embodiment will be described with reference to the drawings.

Figure 1:
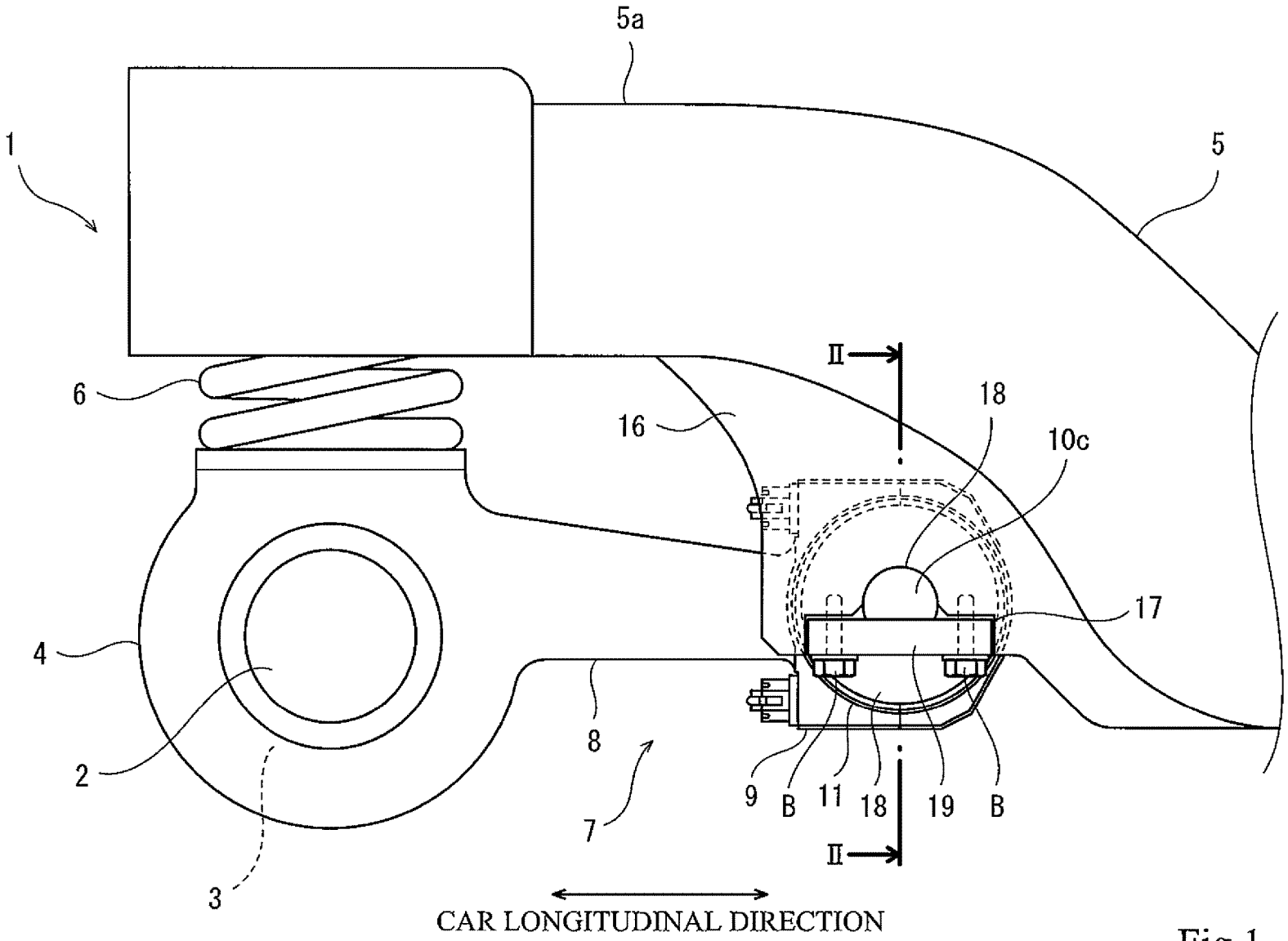
FIG. 1 is a side view of an axle box suspension of a railcar according to an embodiment.

As shown in FIG. 1, an axle box suspension 1 of a railcar of the embodiment is an axle beam type axle box suspension coupling an axle box 4 to a bogie frame 5. The axle box suspension 1 includes the axle box 4 accommodating a bearing 3 rotatably supporting an axle 2. An axle spring 6 constituted by a coil spring is interposed between the axle box 4 and a side sill 5*a* of the bogie frame 5, the side sill 5*a* being located above the axle box 4. The axle box 4 is coupled to the side sill 5*a* by a coupling mechanism 7. The coupling mechanism 7 includes an axle beam 8 extending integrally from the axle box 4 toward a bogie middle side in a car longitudinal direction (car traveling direction). A tubular portion 9 is provided at a tip end portion of the axle beam 8. The tubular portion 9 includes an inner peripheral surface having a cylindrical shape and is open toward both sides in a car width direction. A core rod 10 is inserted into an internal space of the tubular portion 9 through an elastic bushing 11.

Figure 2:
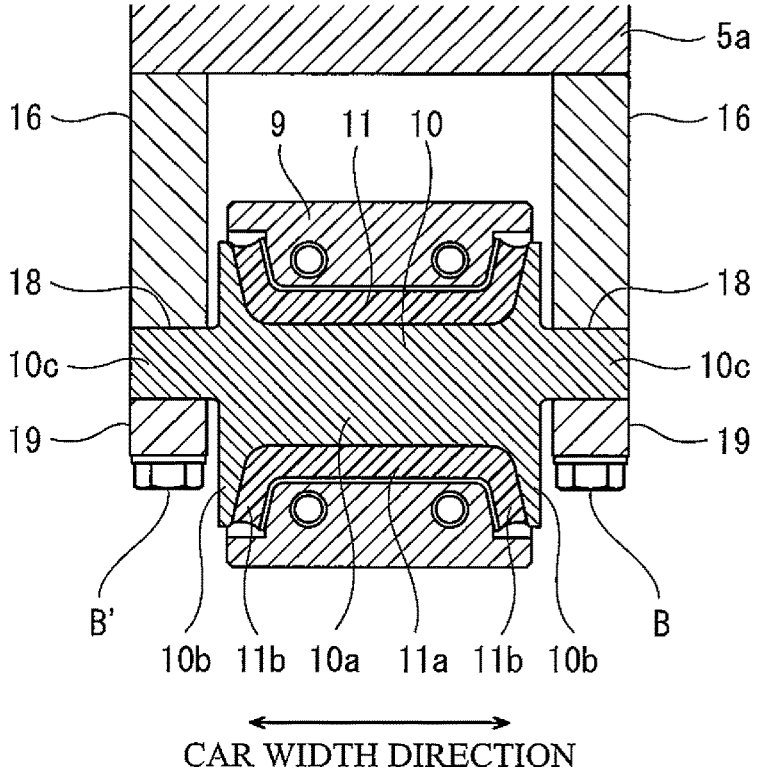
FIG. 2 is a sectional view taken along line II-II of FIG. 1.
Figure 3:
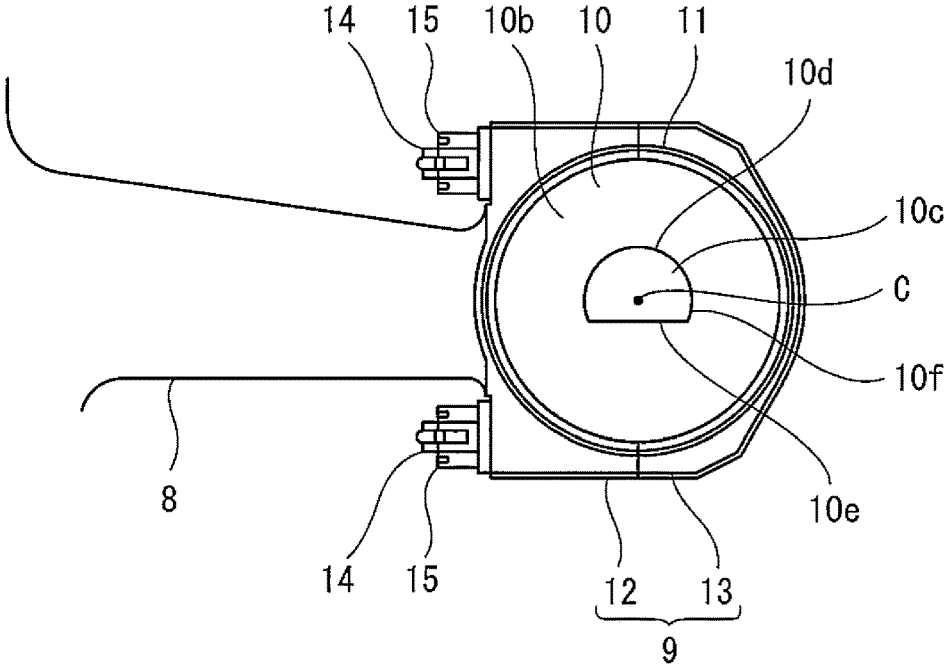
FIG. 3 is a major-components enlarged view in which a receiving seat and a lid in FIG. 1 are omitted.

As shown in FIGS. 2 and 3, the core rod 10 includes a columnar portion 10*a*, a pair of conical flange portions 10*b*, and protruding portions 10*c*. The flange portions 10*b* are provided at both respective car width direction sides of the columnar portion 10*a*. The protruding portions 10*c* project outward in the car width direction from both respective side surfaces of the flange portions 10*b*. Each of upper surfaces 10*d* of the protruding portions 10*c* has a semi-circular surface. Lower surfaces 10*e* of the protruding portions 10*c* are flat surfaces. The lower surface 10*e* of the protruding portion 10*c* is located lower than a center C of of the circular-arc shape of the upper surface 10*d* of the protruding portions 10*c*.

In the protruding portion 10*c*, a width of the lower surface 10*e* in the car longitudinal direction is smaller than a maximum width of the upper surface 10*d* in the car longitudinal direction. A portion 10*f* which is part of an outer peripheral surface of the protruding portion 10*c* and connects the upper surface 10*d* and the lower surface 10*e* to each other has such a shape that a width of the portion 10*f* in the car longitudinal direction decreases as the portion 10*f* extends downward. For example, the portion 10*f* may be a circular-arc surface that is concentric with the circular-arc upper surface 10*d* or may be a tapered surface.

The elastic bushing 11 is, for example, a rubber bushing. The elastic bushing 11 includes a cylindrical portion 11*a* and a pair of conical flange portions 11*b* provided at both respective sides of the cylindrical portion 11*a* in the car width direction. The elastic bushing 11 is externally fitted to the core rod 10. The cylindrical portion 11*a* of the elastic bushing 11 contacts the columnar portion 10*a* of the core rod 10. The flange portions 11*b* of the elastic bushing 11 contacts the respective flange portions 10*b* of the core rod 10.

As shown in FIG. 3, the tubular portion 9 of the axle beam 8 is divided into: a first semi-tubular portion 12 provided integrally with the axle beam 8; and a second semi-tubular portion 13 formed separately from the first semi-tubular portion 12. Inner peripheral surfaces of the first semi-tubular portion 12 and the second semi-tubular portion 13 are formed so as to correspond to outer peripheral surfaces of the cylindrical portion 11*a* and flange portions 11*b* of the elastic bushing 11. The first semi-tubular portion 12 and the second semi-tubular portion 13 sandwich the core rod 10 through the elastic bushing 11 and are fixed to each other by screw rods 14 and nuts 15. By the elasticity of the elastic bushing 11, the tubular portion 9 is allowed to be displaced relative to the core rod 10 in front, rear, left, right, upper, and lower directions.

Figure 4:
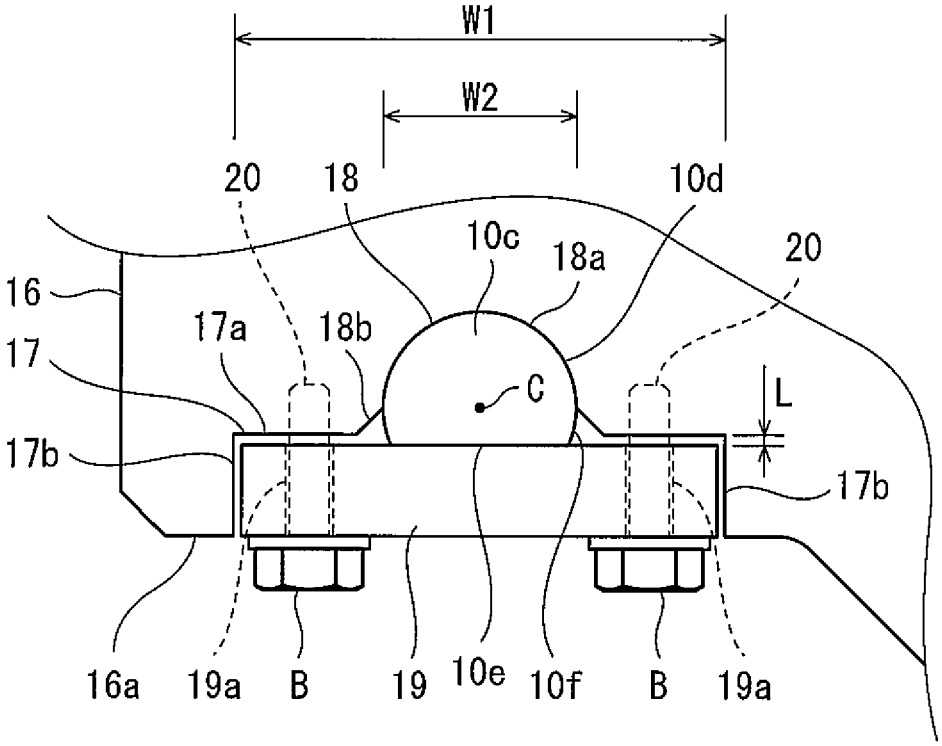
FIG. 4 is a major-components enlarged view showing work of fastening bolts of FIG. 1.

As shown in FIGS. 1, 2, and 4, the side sill 5*a* is provided with a pair of receiving seats 16 projecting downward. Each of the pair of receiving seats 16 includes a recess portion 17 and a groove portion 18. The recess portion 17 is formed by depressing a lower end surface 16*a* of the receiving seat 16 upward and is open toward both sides in the car width direction and a lower side. The recess portion 17 includes a bottom surface 17*a* (a ceiling surface of a space where a lid 19 is arranged) and a pair of side surfaces 17*b* extending downward from both respective car longitudinal direction ends of the bottom surface 17*a*. Each of the bottom surface 17*a* and the side surfaces 17*b* is a flat surface obtained by flattening machining. In the present embodiment, the bottom surface 17*a* is a horizontal surface, and the side surfaces 17*b* are vertical surfaces. However, the shapes of the surfaces 17*a* and 17*b* are not limited to these. For example, the side surfaces 17*b* may be oblique surfaces or curved surfaces.

The groove portion 18 is formed by depressing part of the bottom surface 17*a* of the recess portion 17 upward and is open toward both sides in the car width direction and a lower side. A width W2 of the groove portion 18 in the car longitudinal direction is smaller than a width W1 of the recess portion 17 in the car longitudinal direction. The protruding portion 10*c* of the core rod 10 is fitted into the groove portion 18 from below. In this state, the lid 19 is accommodated in the recess portion 17 so as to contact the lower surface 10*e* of the protruding portion 10*c* of the core rod 10. The lid 19 is fixed to the receiving seat 16 from below by bolts B (fasteners), and the protruding portion 10*c* is supported by the lid 19 from below. In the present embodiment, a direction in which the bolt B is fastened is a vertical direction.

As shown in FIGS. 1 and 4, regarding the direction in which the bolt B is fastened, a depth of the groove portion 18 is smaller than a height of the protruding portion 10*c*. To be specific, with the protruding portion 10*c* fitted into the groove portion 18, the protruding portion 10*c* projects toward the lid 19 (lower side) beyond the bottom surface 17*a* of the recess portion 17. The groove portion 18 includes a circular-arc surface 18*a* formed by curved surface machining. The circular-arc surface 18*a* has a semi-circular shape that is convex upward along the upper surface 10*d* (circular-arc surface) of the protruding portion 10*c*. To be specific, each of a contact surface of the protruding portion 10*c* and a contact surface of the groove portion 18 which surfaces contact each other is a circular-arc surface.

The groove portion 18 further includes a pair of tapered surfaces 18*b*. The pair of tapered surfaces 18*b* are continuous with both respective car longitudinal direction lower ends of the circular-arc surface 18*a*. Further, the pair of tapered surfaces 18*b* are inclined so as to be away from each other as they extend downward. Lower ends of the tapered surfaces 18*b* are continuous with the bottom surface 17*a* of the recess portion 17. Internal screw holes 20 are formed on the bottom surface 17*a* of the recess portion 17 of the receiving seat 16 so as to be located at both respective sides of the groove portion 18.

The lid 19 includes at least surfaces opposed to the lower surface 10*e* of the protruding portion 10*c*, the bottom surface 17*a* of the recess portion 17, and the side surfaces 17*b* of the recess portion 17. In the lid 19, the surface opposed to the bottom surface 17*a* of the recess portion 17 and the surface opposed to the lower surface 10*e* of the protruding portion 10*c* are continuously formed on the same plane. To be specific, a flat upper surface of the lid 19 is a surface opposed to the lower surface 10*e* of the protruding portion 10*c* and the bottom surface 17*a* of the recess portion 17. As one example, the lid 19 has a rectangular solid shape. However, the shape of the lid 19 is not limited to this and may be, for example, a trapezoidal shape in a side surface.

Through holes 19*a* extending in the vertical direction are formed on the lid 19 at positions corresponding to the internal screw holes 20. With the protruding portion 10*c* fitted into the groove portion 18, the lid 19 is fitted into the recess portion 17, and the upper surface of the lid 19 contacts the lower surface 10*e* of the protruding portion 10*c*. The bolts B are fastened to the internal screw holes 20 through the through holes 19*a* of the lid 19.

As shown in FIG. 4, when fixing the lid 19 to the receiving seat 16 by the bolts B, the lid 19 first contacts the lower surface 10*e* of the protruding portion 10*c* before the bottom surface 17*a* of the recess portion 17. To be specific, at the moment when the lid 19 is fitted into the recess portion 17 from below, and the upper surface of the lid 19 starts contacting the lower surface 10*e* of the protruding portion 10*c*, a gap having a distance L exists between the lid 19 and the bottom surface 17*a* of the recess portion 17. In this state, by further fastening the bolts B, the lid 19 presses the protruding portion 10*c* upward, and therefore, the protruding portion 10*c* is strongly held between the groove portion 18 and the lid 19.

To be specific, the pressing force generated by the lid 19 when fastening the bolts B acts on the lower surface 10*e* of the protruding portion 10*c* more preferentially than on the receiving seat 16. Then, contact pressure between a lower surface of the groove portion 18 and a top surface of the protruding portion 10*c* is higher than contact pressure between a side surface of the groove portion 18*b* and a side surface of the protruding portion 10*c*. Therefore, load acting on the core rod 10 in the car width direction can be received by frictional force between the groove portion 18 and the protruding portion 10*c*. Since the shape of the groove portion 18 is a circular-arc shape, the generation of the stress concentration can be suppressed even at a load path of the bogie frame 5.

According to the above-described configuration, the width W1 of the recess portion 17 of the receiving seat 16 at which the lid 19 is positioned is larger than the width W2 of the groove portion 18 at which the protruding portion 10*c* of the core rod 10 is positioned, and therefore, the position of the recess portion 17 in the car longitudinal direction and the position of the groove portion 18 in the car longitudinal direction are not required to surely coincide with each other. On this account, the requirement of the machining accuracy regarding the relative positional relation between the recess portion 17 and the groove portion 18 can be significantly relaxed. Especially, in the present embodiment, since the groove portion 18 has a circular-arc surface, and the recess portion 17 has a flat surface, these surfaces are formed through separate steps. However, since the requirement of the positional accuracy between the machining of the circular-arc surface and the machining of the flat surface is relaxed, the effect of facilitating the machining becomes significant.

With the protruding portion 10*c* fitted into the groove portion 18, the protruding portion 10*c* projects toward the lid 19 beyond the bottom surface 17*a* of the recess portion 17. Therefore, the protruding portion 10*c* can be strongly held by the lid 19 and the groove portion 18 of the receiving seat 16. Further, in the lid 19, the surface opposed to the bottom surface 17*a* of the recess portion 17 and the surface opposed to the lower surface 10*e* of the protruding portion 10*c* are continuously formed on the same plane. Therefore, as compared to the case of using a lid having a convex upper surface, the generation of local stress at the lid 19 can be suppressed. Further, since the lid 19 is only required to be fitted in the recess portion 17, the requirement of the positional accuracy can be relaxed, and the machining and production of the lid 19 can be easily performed. The internal screw holes 20 for fastening the bolts are formed on the bottom surface 17*a* of the recess portion 17. Therefore, the lid 19 does not have to significantly protrude from the receiving seat 16, and compact appearance can be realized as compared to a case where the internal screw holes 20 are formed on the lower end surface 16*a* of the receiving seat 16.

The present invention is not limited to the above-described embodiment. Modifications, additions, and eliminations may be made with respect to the configuration of the present invention. For example, the portion 10*f* connecting the upper surface 10*d* and the lower surface 10*e* in the outer peripheral surface of the protruding portion 10*c* of the core rod 10 may be a surface which is not inclined relative to the direction of the fastening of the bolt B and is parallel to the direction of the fastening of the bolt B. The groove portion 18 does not have to include the tapered surfaces 18*b* and may include only the circular-arc surface 18*a*. The tubular portion 9 may have a two-piece structure including front and rear pieces, a two-piece structure including upper and lower pieces, or an integrated structure.

The direction in which the bolt B is fastened is not limited to the vertical direction and may be a direction inclined with respect to the vertical direction. The side sills may be omitted from the bogie frame, and the receiving seats 16 may be provided at the cross beam of the bogie frame. In this case, a plate spring extending in the car longitudinal direction may be used as the axle spring instead of the coil spring, a middle portion of the plate spring may support the cross beam, and both longitudinal direction end portions of the plate spring may be supported by the axle boxes. The core rod 10 is fitted into the groove portion 18 from below. However, the positions of the groove portion 18 and the lid 19 may be vertically reversed, and the core rod 10 may be fitted into the groove portion 18 from above. The axle box suspension is an axle beam type as one example in the present embodiment, but the present embodiment is not limited to this, and various types may be used.

REFERENCE SIGNS LIST

1 axle box suspension
4 axle box
5 bogie frame
8 axle beam
9 tubular portion
10 core rod
10*c* protruding portion
10*d* upper surface (circular-arc surface)
11 elastic bushing
16 receiving seat
17 recess portion
17*a* bottom surface
17*b* side surface
18 groove portion
18*a* circular-arc surface
19 lid
20 internal screw hole
B bolt (fastener)

The invention claimed is:

1. An axle box suspension of a railcar, the axle box suspension coupling an axle box to a bogie frame, the axle box suspension comprising:

a coupler extending from the axle box in a car longitudinal direction and including a tubular portion at a tip end portion of the coupler, the tubular portion being open toward both sides in a car width direction, the coupler coupling the axle box and the bogie frame;

a core rod inserted into an internal space of the tubular portion, a pair of protruding portions being provided at both respective sides of the core rod in the car width direction;

an elastic bushing interposed between the tubular portion and the core rod;

a pair of receiving seats provided at the bogie frame and including a pair of recess portions and a pair of groove portions formed by depressing parts of bottom surfaces of the pair of recess portions;

a pair of lids supporting the pair of protruding portions fitted into the pair of groove portions, the pair of lids being fitted into the pair of recess portions; and fasteners fixing the lids to the receiving seats, wherein:

each lid includes a flat surface that includes:

a first surface part opposed to the bottom surface of the respective recess portion; and a second surface part opposed to a lower surface of the respective protruding portion, the first surface part and the second surface part are continuously formed on a same plane, each of the groove portions includes a pair of tapered surfaces at both ends of the corresponding groove portion in the car longitudinal direction, and the pair of tapered surfaces are inclined so as to be away from each other as the pair of tapered surfaces extend toward the bottom surfaces.

2. The axle box suspension according to claim 1, wherein:

each of a contact surface of the protruding portion and a contact surface of the groove portion which surfaces contact each other has a circular-arc surface; and each of a pair of car longitudinal direction side surfaces of the recess portion includes a flat surface parallel to a direction in which the fasteners are fastened.

3. The axle box suspension according to claim 1, wherein with the protruding portion fitted into the groove portion, the protruding portion projects toward the lid beyond the bottom surface of the recess portion.

4. The axle box suspension according to claim 1, wherein:

internal screw holes are formed on the bottom surface of the recess portion so as to be located at both respective sides of the groove portion;

the fasteners are fastened to the internal screw holes through the lid.

5. The axle box suspension according to claim 1, wherein each of the lids has a rectangular solid shape.

6. The axle box suspension according to claim 1, wherein the coupler is an axle beam.

* * * * *